US010230189B2

(12) United States Patent
Droesbeke et al.

(10) Patent No.: US 10,230,189 B2
(45) Date of Patent: Mar. 12, 2019

(54) CONNECTOR AND PIN RECEIVING CONTACT FOR SUCH A CONNECTOR

(71) Applicant: Amphenol FCI Asia Pte. Ltd., Singapore (SG)

(72) Inventors: Gert Julien Droesbeke, Chartres (FR); Aymeric Soudy, Besancon (FR)

(73) Assignee: Amphenol FCI Asia Pte Ltd, Singapore (SG)

( * ) Notice: Subject to any disclaimer, the term of this patent is extended or adjusted under 35 U.S.C. 154(b) by 0 days.

(21) Appl. No.: 15/101,533

(22) PCT Filed: Dec. 3, 2013

(86) PCT No.: PCT/EP2013/075350
§ 371 (c)(1),
(2) Date: Jun. 3, 2016

(87) PCT Pub. No.: WO2015/081986
PCT Pub. Date: Jun. 11, 2015

(65) Prior Publication Data
US 2016/0359251 A1 Dec. 8, 2016

(51) Int. Cl.
*H01R 13/11* (2006.01)
*H01R 43/16* (2006.01)

(52) U.S. Cl.
CPC ..... *H01R 13/113* (2013.01); *H01R 43/16* (2013.01)

(58) Field of Classification Search
CPC ..... H01R 43/16; H01R 13/113
USPC ..... 439/866, 885, 246, 252, 842, 852, 850, 439/877, 862
See application file for complete search history.

(56) References Cited

U.S. PATENT DOCUMENTS 3,663,931 A 5/1972 Brown
3,665,378 A 5/1972 Hammell et al.
3,781,770 A 12/1973 Mancini
3,823,392 A * 7/1974 Pfeifer ..... H01R 13/112 439/856
3,836,947 A 9/1974 Yeager
4,317,609 A 3/1982 Lapraik
4,379,611 A 4/1983 Foege et al.
4,480,386 A 11/1984 Adams
(Continued)

FOREIGN PATENT DOCUMENTS

CN 1152807 A 6/1997
CN 1328361 A 12/2001
(Continued)

OTHER PUBLICATIONS

International Search Report and Written Opinion for International Application No. PCT/EP2013/075350 dated Jul. 18, 2014.
(Continued)

*Primary Examiner* — Abdullah Riyami
*Assistant Examiner* — Nelson R Burgos-Guntin
(74) *Attorney, Agent, or Firm* — Wolf, Greenfield & Sacks, P.C.

(57) ABSTRACT

A pin receiving terminal contact and a connector comprising one or more of such terminal contacts. The terminal contacts (1) comprise a base (13) comprising a folded strip and at least a first contact beam (3, 5) having a root end extending from said base (13) and a contact face (11, 12) bent sideward under an angle with said root end.

33 Claims, 9 Drawing Sheets

(56) References Cited

Figure 1:
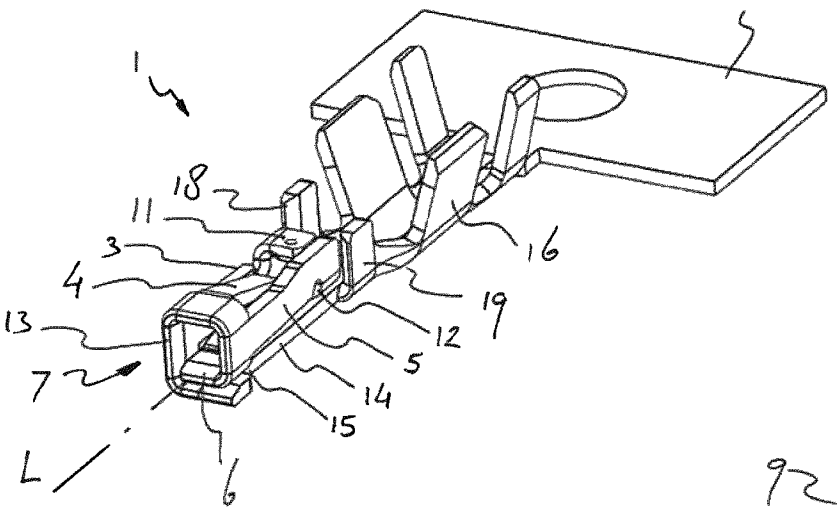

U.S. PATENT DOCUMENTS 4,720,272 A 1/1988 Durand
4,722,704 A 2/1988 VanDerStuyf et al.
4,898,548 A 2/1990 Case et al.
4,900,271 A 2/1990 Colleran et al.
4,950,183 A 8/1990 Watanabe
5,252,097 A 10/1993 Lindeberg et al.
5,259,796 A 11/1993 Yamada et al.
5,281,175 A 1/1994 Chupak et al.
5,344,194 A 9/1994 Hatagishi et al.
5,382,177 A 1/1995 Hutchinson, Jr. et al.
5,575,671 A 11/1996 Katsuma
5,593,328 A 1/1997 Okada et al.
5,651,700 A 7/1997 Sato et al.
5,658,174 A * 8/1997 Benes ..... H01R 13/187 439/842
5,681,190 A 10/1997 Childs
5,690,517 A 11/1997 Betsui
5,735,717 A 4/1998 Nabeshima
5,762,524 A 6/1998 Ford et al.
5,865,636 A 2/1999 Myer et al.
5,897,405 A * 4/1999 Endo ..... H01R 13/11 439/852
5,938,485 A 8/1999 Hotea et al.
5,951,339 A 9/1999 Chaillot
6,039,615 A 3/2000 Suzuki et al.
6,174,208 B1 1/2001 Chen
6,186,810 B1 * 2/2001 Barnabe ..... H01R 13/187 439/252
6,193,551 B1 2/2001 Yamamoto et al.
6,299,489 B1 * 10/2001 Phillips ..... H01R 13/111 439/252
6,305,992 B1 10/2001 Bouda et al.
6,315,591 B2 * 11/2001 Oda ..... H01R 13/18 439/246
6,338,638 B2 * 1/2002 Kodama ..... H01R 13/11 439/246
6,379,199 B1 4/2002 Chen
6,402,571 B1 6/2002 Muller et al.
6,439,935 B2 * 8/2002 Saka ..... H01R 13/113 439/842
6,447,345 B2 * 9/2002 Sato ..... H01R 43/16 439/842
6,475,040 B1 11/2002 Myer et al.
6,524,135 B1 2/2003 Feldman et al.
6,547,608 B2 4/2003 Sato et al.
6,558,176 B1 5/2003 Martin et al.
6,585,544 B2 * 7/2003 Furutani ..... H01R 13/113 439/252
6,669,507 B2 12/2003 Yamanashi et al.
6,679,736 B2 1/2004 Saka
6,736,684 B2 * 5/2004 Ishiyama ..... H01R 13/187 439/852
6,755,697 B2 * 6/2004 Kojima ..... H01R 13/114 439/595
6,971,927 B2 * 12/2005 Anbo ..... H01R 13/113 439/852
7,048,582 B2 * 5/2006 Tabata ..... H01R 13/113 439/595
7,144,281 B2 * 12/2006 Maeda ..... H01R 13/113 439/595
7,156,704 B2 * 1/2007 Shimizu ..... H01R 13/113 439/852
7,179,138 B2 * 2/2007 Nora ..... H01R 13/422 439/843
7,252,564 B1 8/2007 Morello et al.
7,278,883 B2 10/2007 Tyler
7,294,027 B1 11/2007 Tyler
7,300,319 B2 * 11/2007 Lutsch ..... H01R 4/185 439/845
7,303,027 B1 12/2007 Laemmer
7,351,122 B2 4/2008 Suemitsu et al.
7,442,058 B2 10/2008 Ohtaka et al.
7,938,695 B2 5/2011 Furutani et al.
7,950,972 B1 5/2011 Chen et al.
7,976,351 B2 7/2011 Boemmel et al.
8,043,130 B2 10/2011 Casses et al.
8,241,076 B2 8/2012 Kubota
8,241,077 B2 8/2012 Suzuki et al.
8,747,156 B2 6/2014 Hirabayashi
8,974,256 B2 * 3/2015 Okano ..... H01R 13/11 439/852
9,011,186 B2 * 4/2015 Wirth ..... H01R 13/112 439/843
9,039,467 B2 5/2015 Seipel et al.
9,054,431 B2 6/2015 Endo
9,130,282 B2 * 9/2015 Suzuki ..... H01R 4/185
9,136,641 B2 9/2015 Bishop
9,166,325 B2 10/2015 Bishop
9,446,893 B2 9/2016 Haimi
9,466,893 B2 10/2016 Bishop
9,570,854 B2 * 2/2017 Hashimoto ..... H01R 13/642
9,601,854 B2 * 3/2017 Kutsuna ..... H01R 13/113
2001/0051472 A1 12/2001 Sato et al.
2002/0076999 A1 6/2002 Chen
2002/0160666 A1 10/2002 Sato et al.
2003/0054681 A1 3/2003 Hatagishi et al.
2003/0057958 A1 3/2003 Fukushima et al.
2003/0199185 A1 10/2003 Fujii et al.
2003/0220015 A1 * 11/2003 Ishiyama ..... H01R 13/187 439/595
2004/0142605 A1 7/2004 Harada et al.
2005/0153605 A1 7/2005 Anbo et al.
2005/0227551 A1 10/2005 Tabata et al.
2005/0287877 A1 12/2005 Fukuda et al.
2006/0035538 A1 * 2/2006 Suemitsu ..... H01R 13/113 439/852
2006/0073741 A1 4/2006 Bommersheim
2006/0094305 A1 5/2006 Masaki et al.
2006/0234535 A1 10/2006 Ohtaka et al.
2008/0070452 A1 3/2008 Komiyama et al.
2008/0280510 A1 * 11/2008 Moll ..... H01R 4/185 439/877
2010/0015863 A1 1/2010 Sugiyama et al.
2010/0197177 A1 8/2010 Myer et al.
2010/0197178 A1 8/2010 Hotea et al.
2011/0053405 A1 3/2011 Kobayashi et al.
2011/0086557 A1 * 4/2011 Kubota ..... H01R 13/113 439/842
2011/0117761 A1 5/2011 Loncar et al.
2011/0151694 A1 6/2011 Horiuchi et al.
2011/0212656 A1 9/2011 Suzuki et al.
2012/0034827 A1 2/2012 Ishikawa et al.
2012/0142233 A1 * 6/2012 Blasko ..... H01R 13/113 439/852
2012/0214360 A1 * 8/2012 Kumakura ..... H01R 4/04 439/878
2012/0264340 A1 10/2012 Mueller
2012/0295493 A1 11/2012 Hirabayashi
2012/0329341 A1 * 12/2012 Morikawa ..... H01R 4/185 439/866
2013/0017697 A1 1/2013 Furuya et al.
2013/0102180 A1 4/2013 Muro
2013/0143454 A1 6/2013 Onuma et al.
2013/0288546 A1 * 10/2013 Okano ..... H01R 13/11 439/852
2013/0288547 A1 10/2013 Amano et al.
2014/0287621 A1 * 9/2014 Smutny ..... H01R 31/08 439/574
2015/0050838 A1 * 2/2015 Copper ..... H01R 13/114 439/626
2015/0222038 A1 * 8/2015 Volpone ..... H01R 13/113 439/842
2015/0263453 A1 9/2015 Wang et al.
2015/0303593 A1 10/2015 Ono
2016/0104948 A1 4/2016 Droesbeke et al.

(56) References Cited

U.S. PATENT DOCUMENTS

| | | | | |
|---|---|---|---|---|
| 2016/0118745 | A1* | 4/2016 | Droesbeke | H01R 13/4368 385/76 |
| 2016/0359251 | A1* | 12/2016 | Droesbeke | H01R 13/113 |

FOREIGN PATENT DOCUMENTS

| | | | |
|---|---|---|---|
| CN | 102119470 | A | 7/2011 |
| CN | 102195182 | A | 9/2011 |
| CN | 202651500 | U | 1/2013 |
| CN | 102971918 | A | 3/2013 |
| DE | 10 2004 052 378 | A1 | 5/2006 |
| DE | 10 2006 062704 | A1 | 2/2008 |
| DE | 202013001074 | U1 | 4/2013 |
| JP | H11-40233 | A | 2/1999 |
| JP | 2000-067975 | A1 | 3/2000 |
| JP | 2000-173703 | A | 6/2000 |
| JP | 2001-135398 | A | 5/2001 |
| JP | 2003-022872 | A | 1/2003 |
| JP | 2003-068397 | A | 3/2003 |
| JP | 3390331 | B2 | 3/2003 |
| JP | 2005-302581 | | 10/2005 |
| JP | 2009-283308 | A | 12/2009 |
| WO | WO 2010/015894 | A1 | 2/2010 |
| WO | WO 2011/067632 | A1 | 6/2011 |
| WO | WO 2011/087863 | A2 | 7/2011 |
| WO | WO 2013/046663 | A1 | 4/2013 |

OTHER PUBLICATIONS

International Preliminary Report on Patentability for International Application No. PCT/EP2013/075350 dated Jun. 16, 2016.
U.S. Appl. No. 14/893,995, filed Nov. 25, 2015, Droesbeke et al.
U.S. Appl. No. 14/459,603, filed Aug. 14, 2014, Copper et al.
EP 14838530.5, Feb. 21, 2017, Extended European Search Report.
PCT/IB2013/001340, Feb. 3, 2014, International Search Report and Written Opinion.
PCT/IB2013/001340, Dec. 17, 2015, International Preliminary Report on Patentability.
PCT/US2014/051203, Nov. 21, 2014, International Search Report and Written Opinion.
PCT/US2014/051203, Mar. 3, 2016, International Preliminary Report on Patentability.
Extended European Search Report dated Feb. 21, 2017 for Application No. EP 14838530.5.
International Search Report and Written Opinion dated Feb. 3, 2014 for Application No. PCT/IB2013/001340.
International Preliminary Report on Patentability dated Dec. 17, 2015 for Application No. PCT/IB2013/001340.
International Search Report and Written Opinion dated Nov. 21, 2014 for Application No. PCT/US2014/051203.
International Preliminary Report on Patentability dated Mar. 3, 2016 for Application No. PCT/US2014/051203.

* cited by examiner

CONNECTOR AND PIN RECEIVING CONTACT FOR SUCH A CONNECTOR

CROSS-REFERENCE TO RELATED APPLICATION

This application is the National Stage of International Application No. PCT/EP2013/075350, filed Dec. 3, 2013, which application is hereby incorporated by reference to the maximum extent allowable by law.

The invention relates to a connector configured to be coupled with a pin header connector and to pin receiving contacts for such a connector. The invention also relates to a method of manufacturing such contacts.

Such cable connectors are for instance used in automotive applications, e.g., for cooperation with an on-board pin header connector on a printed circuit board or a similar substrate. Such connectors are typically provided with pin receiving contacts comprising contact beams resiliently engaging an inserted contact pin of a complementary pin header connector. The contact between the contact beams and an inserted contact pin should be sufficient to conduct required amounts of current. The contact should also be reliable, particularly when it is exposed to vibrational loads, as may occur in automotive practice. Contact between the terminal contact and an inserted contact beam can be improved by using more contact points.

Contact pins are usually provided with a coating of gold or another precious metal on the contact face. Since gold does not oxidize, a gold coating helps to improve electro-conductive contact between the pin and the terminal contact. It also helps to reduce friction between the contact pin and the terminal contact during insertion of the pin. Increase of the number of contact points would increase the required gold consumption and the manufacturing costs of the terminal contact.

It is an object of the invention to provide a cable connector which can be manufactured economically and which provides good and reliable contact with an inserted contact pin.

To this end, a connector is disclosed with one or more pin receiving terminal contacts with a base comprising a folded strip. The terminal contact has at least a first contact beam having a root end extending from the base and a contact face bent sideward under an angle with said root end.

The base can for example be rectangular, square, polygonal or circular, C-shaped or U-shaped, when viewed in a pin insertion direction, e.g. folded over at least two folding lines substantially parallel to a pin insertion direction. This way, it can support a plurality of parallel contact beams at different sides of the terminal contact. It may form a pin receiving opening forming a passage of a contact pin of a mating counterconnector or it may be an opening in line with a pin insertion direction. If the contact beams extend in a direction coinciding with the pin insertion direction, the base will typically be a pin receiving opening. In case the contact beams extend in the opposite direction, the base is not necessarily a pin receiving opening.

In a specific embodiment, the terminal contact provides at least one pair of contact points at one or more sides. The contact points of a pair at one side of the terminal contact can be positioned on different contact beams. Having two contact points on different contact beams at the same side of the terminal contact enables to provide a reliable contact which is less sensitive for vibrational loads and which requires less gold consumption.

To balance contact forces, the terminal contact may for instance comprise at least two pairs of contact points at opposite sides of the terminal contact.

The contact points of a pair may for example be positioned on contact beams resiliently flexed in different bending directions. For instance, a first contact beam can be flexed towards the center of the pin receiving space, while the second contact beam comprises a contact point on a sideward bent flange or flag. This results in different vibrational behaviour, so the vibration resistance of the contact as a whole is increased.

In a specific embodiment, the terminal contact of may have a first contact beam extending from a first side of the base, and a second contact beam extending from an adjacent second side of the base, the contact face of the first contact beam being bent sideward to be in line with said second contact beam. In a more specific embodiment, the terminal contact may comprise a third contact beam facing the first contact beam and extending from a third side of the base, and a fourth beam facing the second contact beam and extending from an adjacent fourth side of the base. The third contact beam may comprise a contact face bent sideward to be in line with said fourth contact beam.

Optionally, the pin receiving space is four-sided in cross section, two opposite sides being defined by the longer contact beams while the other two sides are defined by the shorter contact beams. The tips of the longer contact beams may for example comprise flanges forming rear contact faces, the flanges being folded to be in line with the shorter contact beams. In that case each pair of contact points or contact areas includes one front contact area provided by a resiliently biased tip of a forwardly flexed shorter contact beam while the rear contact area is provided by the inwardly bent flange at the tip of the longer contact beam.

The line through the contact points or areas at the same side of the terminal contact can be parallel to the pin insertion direction, or it can make an angle with the pin insertion direction. In the last case, when a contact pin is inserted into the pin receiving space, one contact point will wipe and slide over the left hand side of the contact pin, while the other contact point will wipe and slide over the right hand side of the contact pin. As a result the contact points produce separate wear tracks on the contact pin, so the extent of wear per wear track is less. This enhances durability and the maximum number of possible mating cycles.

The shorter and longer contact beams may for example extend from a base defining a pin receiving opening. The contact beams can extend rearwardly from the base, so the contact pin will first pass the base before being contacted to the contact points. Alternatively, the contact beams can extend forwardly from the base, so the contact pin will first be contacted to the contact points before it passes the base.

Optionally, the terminal contact may comprise a backbone with a connection end projecting from the contact beams, e.g., for connection to a cable end or a printed circuit board or a similar substrate. Such a connection end of the backbone may for example be provided with a crimp connection for attachment to a cable. Other types of cable attachments or printed circuit board connections, such as solder tail (surface mount (SMT) or pin-through-hole (PTH)) or press-fit connections, can also be used, if so desired.

The backbone connects the cable connection end to the base. In case the terminal contact comprises two or more bases, it connects the cable connection to a rear base closest to the cable connection end, and optionally also to the further base, e.g., between the contact beams.

A midsection of the backbone connecting the crimp connection section with the contact beam section, can for example be rigid or it can be made flexible. A flexible mid-section helps to reduce transfer of vibrational loads from the cable connection end to the pin receiving end of the terminal contact.

Optionally, the backbone may overlap one of the contact beams. For instance, the base can be folded in such a way that side of the base carrying said contact beam overlaps the side of the base connected to the backbone. These overlapping end parts of the base can for example be welded, soldered or glued.

In a further possible embodiment of the connector the terminal contact may for example comprise a front base, a rear base and one or more beams having:

- a front section connected to a first side of the front base,
- a rear section connected to a side of the rear base in line with a second side of the front face, and
- a folded mid-section connecting the front end to the rear end.

The beams can be contact beams or merely supporting beams. More specifically, the beams may include a first and second beam being oppositely arranged. The terminal contact may further comprise oppositely arranged third and fourth beams between the first and second beams, both having a root end connected to a side of the front or rear base. For instance, the third and fourth beams may have a root end connected to the front base, a free end extending between the rear sections of the first and second beams and a mid-section bridging the root end and the free end.

In a further embodiment, the connector may comprise a terminal contact comprising at least one contact beam having a root end extending from the base and a contact face bent sideward along a folding line making an acute angle with a pin insertion direction.

A further possible embodiment may comprise a beam, such as a contact beam, extending from one side of the base pre-loading a contact beam extending from an adjacent side of the base. This makes it possible to increase the resilient contact force exerted by the pre-loaded contact beam to a mating contact pin.

Optionally, the connector may comprises a terminal contact with one or more support beams, each backing the contact area of an associated contact beam. The support beam contributes to the normal force exerted by the contact beam to a mating contact pin.

The longer contact beams can be equally dimensioned. Alternatively, they can be configured such that they have a different vibrational behaviour, e.g., with a different stiffness or length. Optionally, the contact areas or contact points of the longer contact beams can be staggered relative to each other, so that contact areas at different sides of the terminal contact are at different distances from the base. Similarly, the shorter contact beams can be configured such that they have a different vibrational behaviour, e.g., with a different stiffness or length or with staggered contact points. These measures help to improve resistance against vibrational loads.

Optionally, one or more contact areas are formed by bulging contact bumps or domes. For instance, the contact terminal may comprise one or more sides with contact areas on different contact beams, at least one of the contact areas on a side being formed by a dome. If a side of the contact terminal has two contact areas of different contact beams, both may be shaped as domes or one of the contact areas may be a dome, while the other is differently shaped, e.g., having a flat contact face or a bent tip. For example, if the first contact area at one side of the terminal contact is formed by a sideward bent flange of a longer contact beam, while the second contact area is formed by a shorter contact beam, the first contact area may be dome shaped, while the second contact area may also be dome shaped or not dome shaped. In such a configuration, the normal force exerted by the first contact area will typically be higher. Notwithstanding the higher normal force, pressure differences between the two contact areas can be reduced by adjusting the surface area of the one of the contact areas, e.g., by adjusting the shape, width, length or curvature of the dome shape.

The invention also relates to the terminal contact as such, which may for instance be folded from a single stamped part of sheet metal.

To manufacture such a contact, a process can be used, comprising the steps of:

- stamping a blank from a sheet metal, the blank comprising a base strip and one or more, e.g., four, contact beams extending from the base strip;
- folding the base strip over at least two folding lines parallel to a pin insertion direction, e.g., to form a C-shape or a substantially square or rectangular opening.

The blank may for example comprise two longer contact beams, a first shorter contact beam between the two longer beams and a second shorter contact beam at a second end of the base strip.

Optionally, the two longer contact beams are provided with sidewardly extending flanges pointing away from the backbone, wherein the flanges are first bent upwardly before folding the base strip.

To allow easier handling of a large number of blanks, a series of blanks can be attached to a transport strip during folding.

Exemplary embodiments of the connector and the terminal contacts will be further explained with reference to the accompanying drawings.

Figure 2:
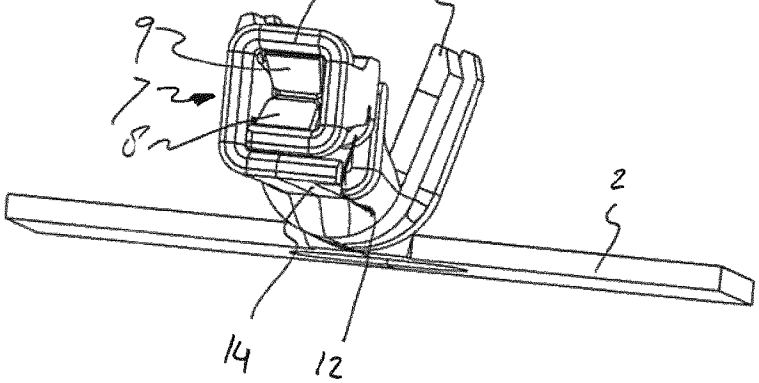
Figure 3:
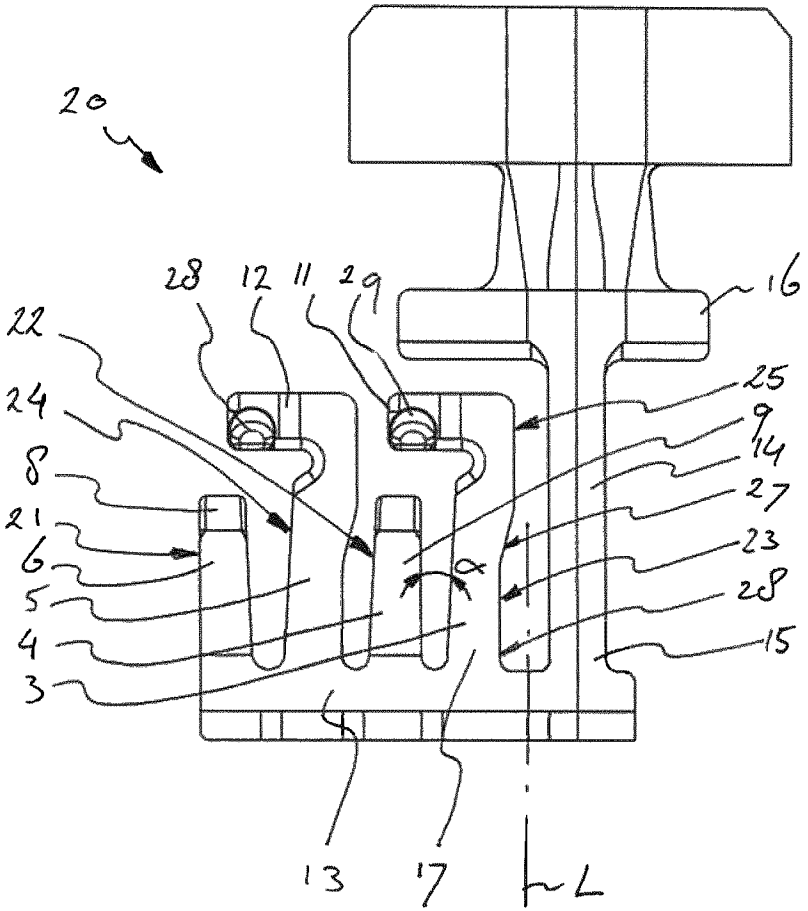
Figure 4:
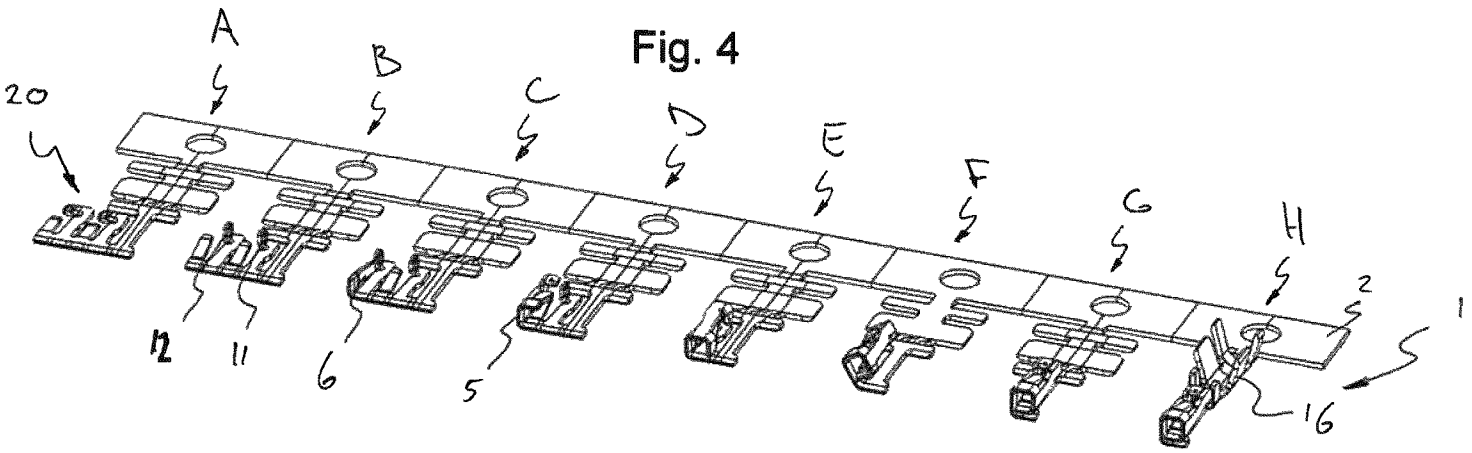
Figure 5D:
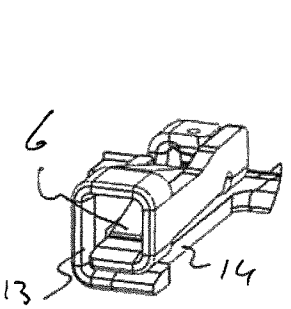
Figure 5C:
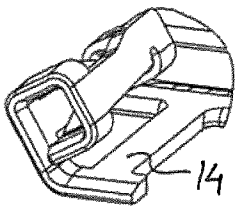
Figure 5B:
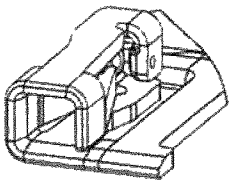
Figure 5A:
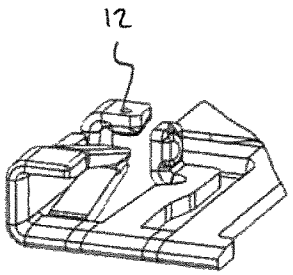
Figure 6:
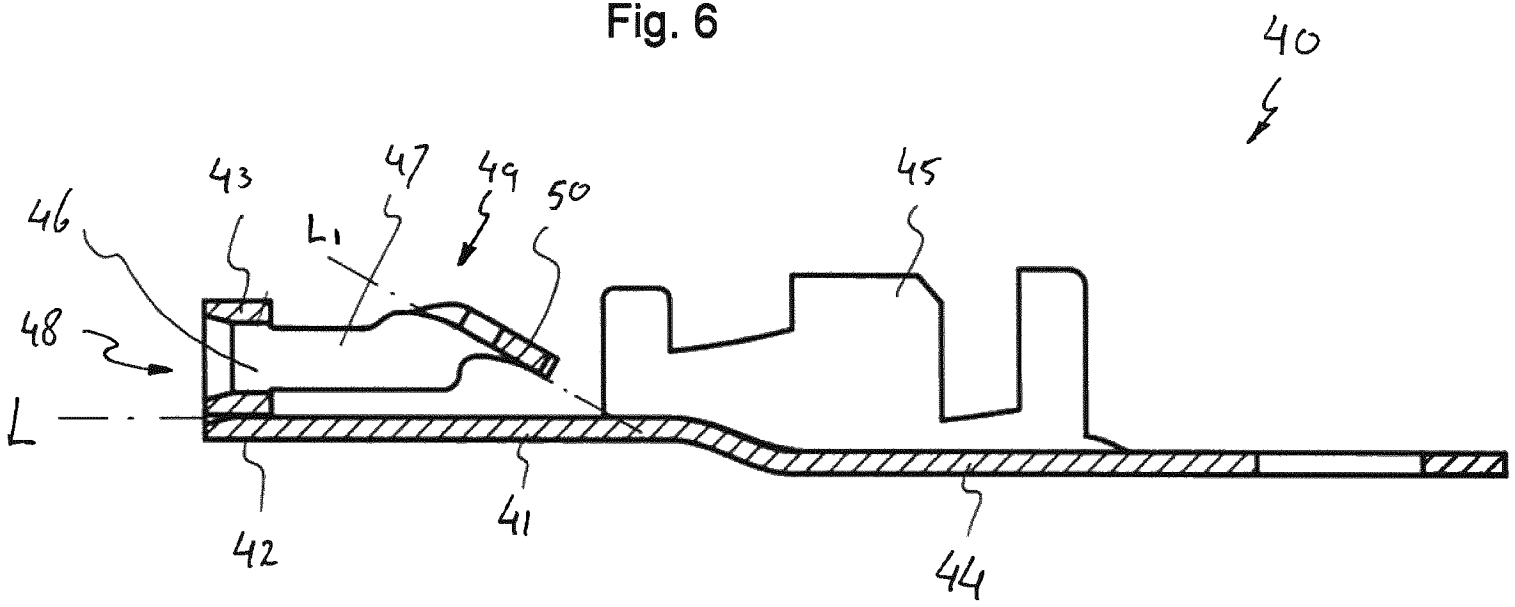
Figure 7:
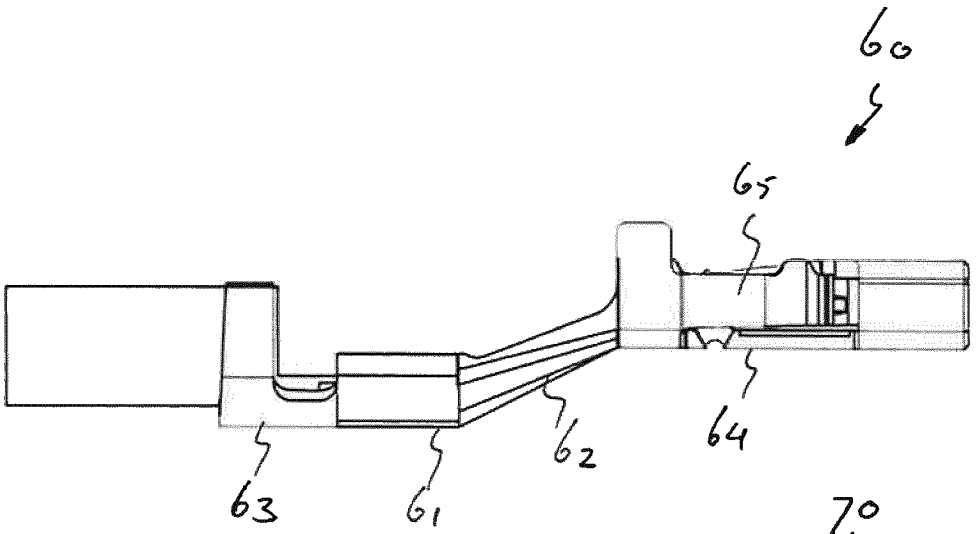
Figure 8:
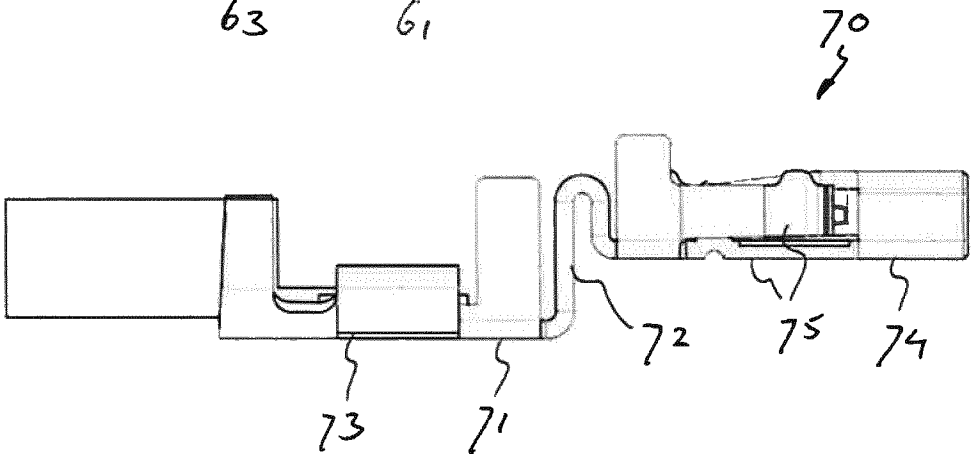
Figure 9:
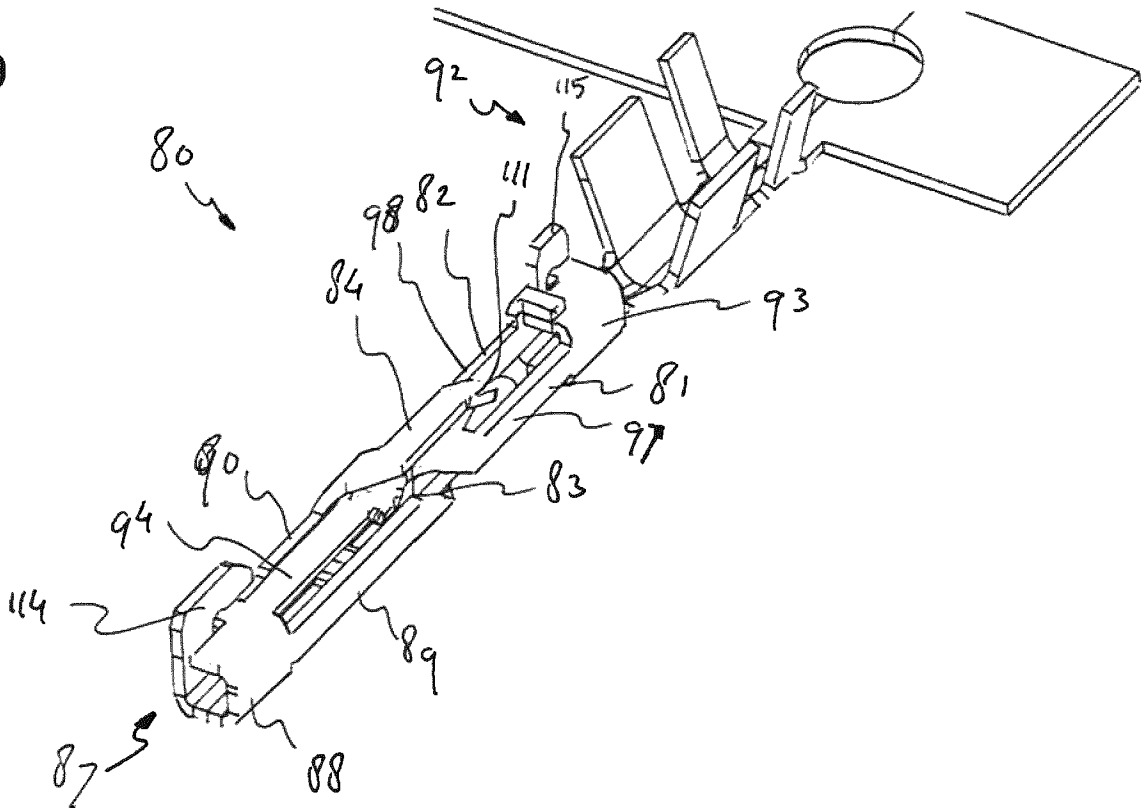
Figure 10:
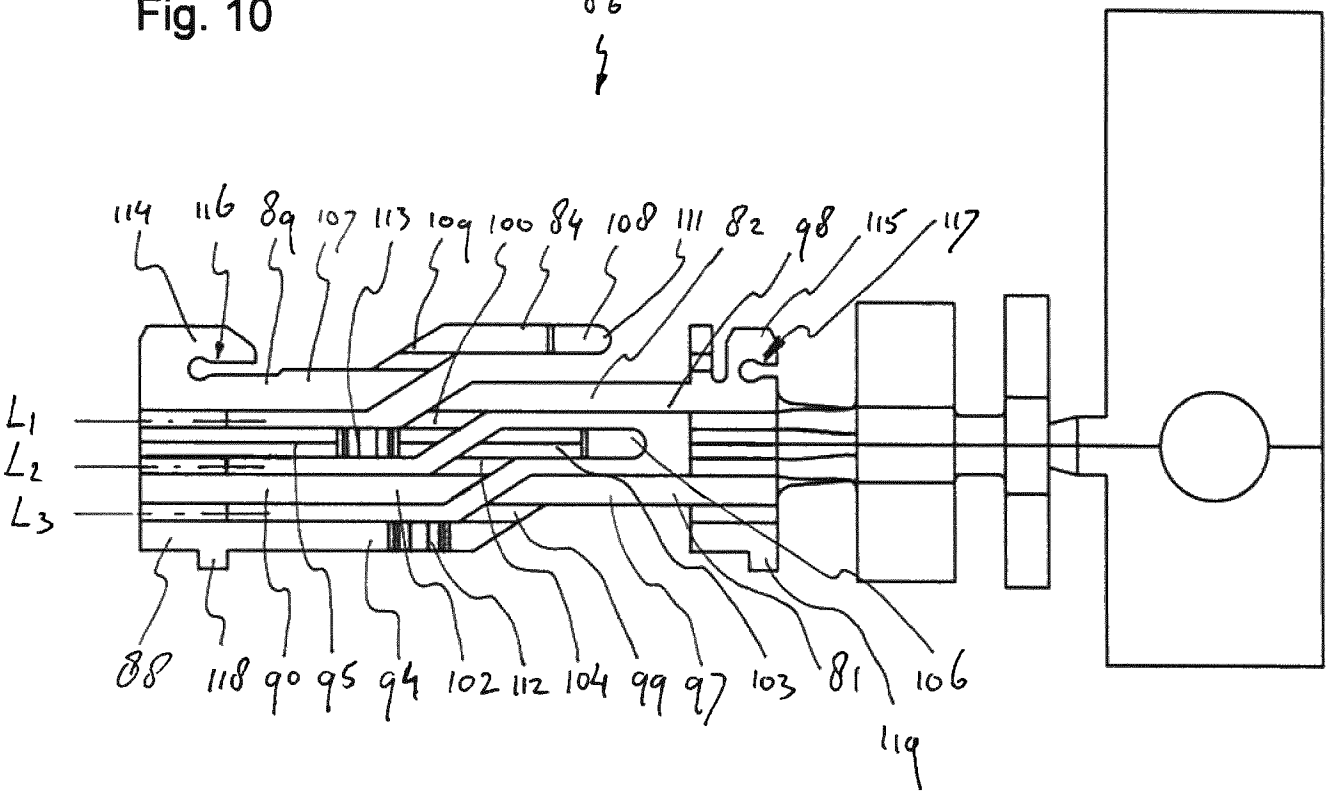
Figure 11:
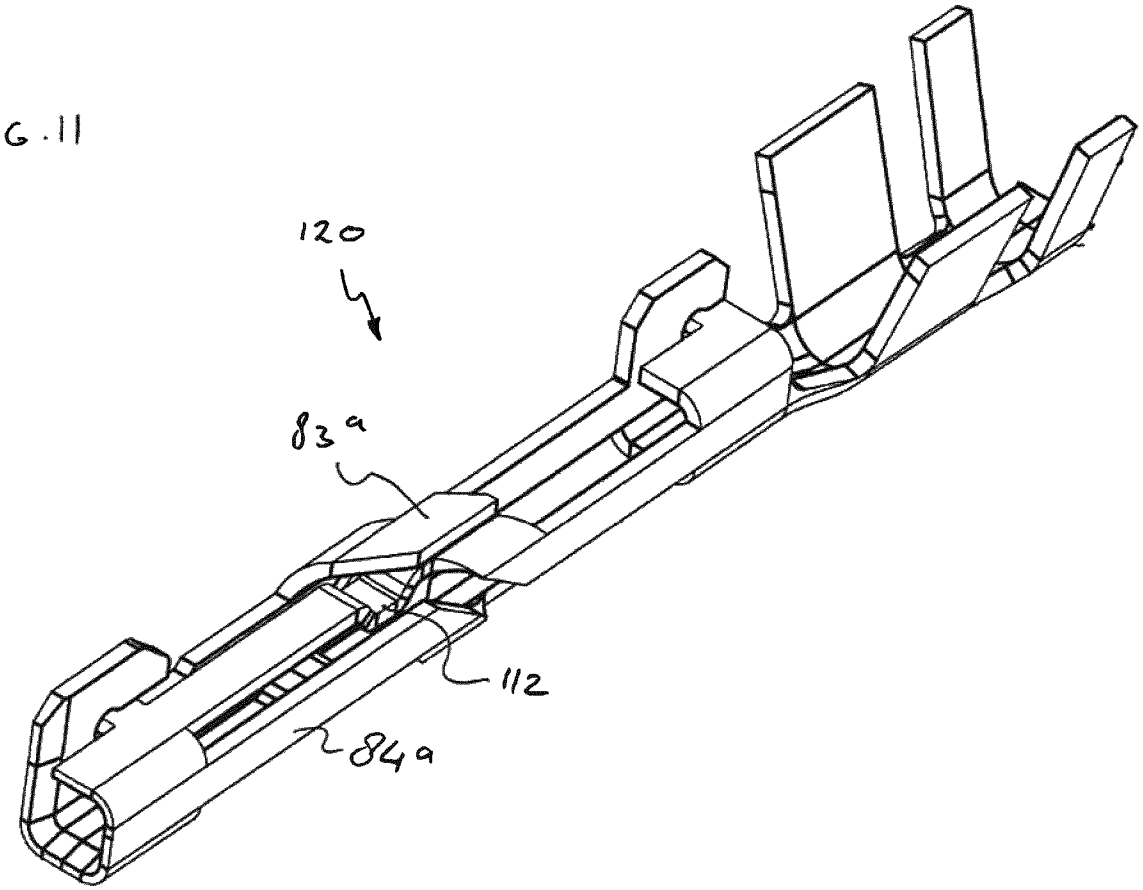
Figure 12:
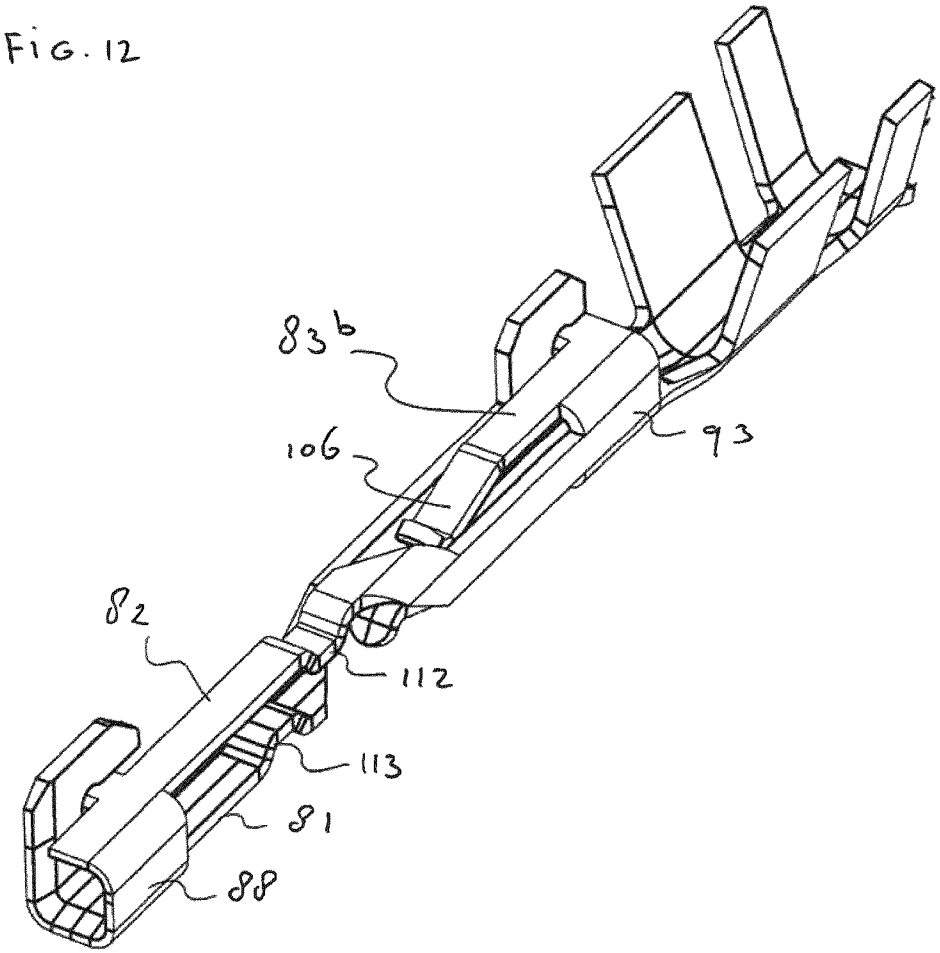

FIG. 1: shows an exemplary terminal contact;

FIG. 2: shows a different perspective view of the terminal contact of FIG. 1;

FIG. 3: shows a blank for making the terminal contact of FIG. 1;

FIG. 4: shows a transportation strip carrying a series of blanks in consecutive stages of the manufacturing process;

FIGS. 5A-D: show consecutive steps of the manufacturing process;

FIG. 6: shows a second embodiment of a terminal contact;

FIG. 7: shows a third embodiment of a terminal contact in side view;

FIG. 8: shows a fourth embodiment of a terminal contact in side view;

FIG. 9: shows a fifth embodiment of a terminal contact in perspective view;

FIG. 10: shows a blank for the terminal contact of FIG. 9;

FIG. 11: shows a further possible embodiment of a terminal contact in perspective view;

FIG. 12: shows a further possible embodiment of a terminal contact in perspective view.

FIG. 1 shows a terminal contact 1 still connected to a piece of a transport strip 2 used during manufacturing. This piece is cut off before connection of the terminal contact 1 to a cable end. The terminal contact 1 has four contact beams 3, 4, 5, 6 defining a pin receiving space 7. The four contact beams 3, 4, 5, 6 include two oppositely arranged shorter contact beams 4, 6 and two longer contact beams 3, 5. The shorter contact beams 4, 6 are bent inwardly with their tips 8, 9 forming front contact points for an inserted contact pin (see FIG. 2).

The tips of the longer contact beams 3, 5 have flanges 11, 12 forming the rear contact points at the inner face of the pin receiving space 7. The flanges 11, 12 have been folded to be in line with the shorter contact beams 4, 6. When a contact pin (not shown) is inserted into the pin receiving space 7, it will first be contacted with the front contact points formed by the tips 8, 9 of the shorter beams and subsequently by the rear contact points formed by the inner faces of flanges 11, 12. The rear contact point formed by the flange 11 is paired and in line with the front contact point formed by the tip end 9 of the shorter contact beam 4 at the same side of the pin receiving space 7. Similarly, the rear contact point formed by the flange 12 is paired and in line with the front contact point formed by the tip end 8 of the shorter contact beam 6 at the same side of the pin receiving space 7.

Due to the different bending directions the front contact points formed by the tips 8, 9 of the shorter contact beams 4, 6 have a different vibrational behaviour than the rear contact points formed by the inwardly bent flanges 11, 12. This improves the overall resistance of the terminal contact 1 against vibrational loads.

The parallel contact beams 3, 4, 5, 6 extend from a base 13, formed by a strip folded to form a square or rectangular ring defining the entrance of the pin receiving space 7. A first folding line L is positioned between the backbone 14 and the contact beams 3, 4, 5, 6 and runs substantially parallel to the contact beams 3, 4, 5, 6 and the backbone 14. Folding the base strip 13 along this folding line L results in a geometry with the contact beams 3, 4, 5, 6 extending in substantially the same direction as the backbone without being coplanar with the backbone 14.

The terminal contact 1 further comprises a backbone 14, extending from the base 13 in a direction parallel to the contact beams 3, 4, 5, 6. In the shown embodiment, the backbone 14 and the contact beams 3, 4, 5, 6 extend rearwardly. This means that a contact pin must first pas the base 13 before it contacts the contact points of the contact beams 3, 4, 5, 6. In an alternative embodiment, the contact beams 3, 4, 5, 6 may extend forwardly with or without a backbone being present, so a contact pin will first contact the longer contact beams 4, 6 and subsequently the shorter contact beams 3, 5.

The contact beams, extending forwardly or rearwardly, may be folded such that a contact beam pre-loads two adjacent, oppositely arranged contact beams by resiliently forcing them apart before insertion of a contact pin. This will result in a higher contact force of the pre-loaded contact beams after insertion of a contact pin.

The backbone 14 has one end opposite to the base 13 provided with a crimp connection 16 allowing electrical and mechanical connection to a terminal end of a cable (not shown). The crimp connection 16 forms a cable connection end and projects from the contact beams 3, 4, 5, 6.

Between the crimp connection 16 and the contact beams 3, 4, 5, 6 the terminal contact 1 is provided with two upwardly folded flanges 18, 19 forming key-coding flags for correctly positioning the terminal contact 1 in a housing of a connector.

Optionally, the contact terminal can be designed for being side loaded into a connector housing or housing part. To that end, the contact can be provided with appropriate flags and/or guiding surfaces. Also the crimp connection, if present, can be designed for being used to position, press fit and or retain the contact into a matching cavity in the housing or housing part.

FIG. 3 shows a blank 20 which can be folded to form the terminal contact, which is substantially similar to the terminal contact 1 of FIG. 1. The blank 20 comprises a base strip for forming the base 13. A first shorter contact beam 6 extends from a first end of the base strip 13, while the backbone 14 extends from the opposite end of the base strip 13. Between the backbone 14 and the short contact beam 6 the base strip 13 carries the two longer contact beams 3, 5 and a second shorter contact beam 4 between the two longer contact beams 3, 5. The two longer contact beams 3, 5 are identical in outline. The two shorter contact beams 4, 6 are mirrored, both having a straight longitudinal side edge 21 and an oblique longitudinal side edge 22 making an angle $\alpha$ of about 5 degrees with the straight side edge, such that the base of the shorter contact beam 4, 6 is wider than its respective tip 8, 9. The oblique side edges 22 of the two shorter contact beams 4, 6 are directed to each other. The tip ends 8, 9 are made convex to improve contact with an inserted contact pin.

Similarly, the two longer contact beams 3, 5 have a straight longitudinal side edge 23 and an oblique longitudinal side edge 24 making an angle of about 5 degrees with the straight side edge 23. However, the top half 25 of the straight edges 23 is slightly offset to the lower half 26 of the straight edge 23 with a oblique mid-section 27 bridging the straight upper and lower halves 25, 26. The top ends of the longer contact beams 3, 5 are provided with the sidewardly extending flanges 11, 12, both pointing away from the backbone 14. The two flanges 11, 12 are provided with imprinted convex contact faces 28, 29.

During manufacture the blanks 20 can be attached to a transportation strip 2, as shown in FIG. 4. The blanks 20 in FIG. 4 are in different stages A-H of the folding process. In the first step A the blank 20 is still flat. In a second step B the flanges 11, 12 of the longer contact beams 3, 5 are folded upwardly along a folding line substantially parallel to the longitudinal length of the contact beams 3, 5. In a third step C the outer shorter contact beam 6 is folded upwardly and flexed slightly inwardly. Then (step D) the next longer contact beam 5 is folded upwardly (see also FIG. 5A). The two shorter beams 4, 6 now face each other, their tips 8, 9 being flexed towards each other. Then in step E the second shorter contact beam 4 is folded upwardly (see FIG. 5B). After a further folding step F, G the outer shorter contact beam 6 overlays the backbone 14. To make the base 13 more rigid the end part of the strip carrying the backbone 14 and the end part of the strip carrying the outer short contact beam 6 can be attached to each other, e.g., by soldering. In a final step the crimp tabs 16 are folded upwardly. The folded terminal contact 1 can now be cut off from the transportation strip 2.

All folding lines extend in a direction substantially parallel to the longitudinal length of the contact beams.

When the terminal contact 1 is folded, the front contact point on the tip end 8 of the outer shorter beam 6 is in line with the convex rear contact point 28 of the flag 12 of the adjacent longer contact beam 5. The paired contact points 8, 28 are at the same side of the pin receiving space 7 and contact a same side of an inserted contact pin.

Similarly, the front contact point on the tip end 9 of the other shorter beam 4 is in line with the convex rear contact point 29 of the flag 11 of the longer contact beam 3 next to the backbone 14. The paired contact points 9, 29 are at the same side of the pin receiving space 7 and contact a same side of an inserted contact pin.

FIG. 6 shows in cross section an alternative embodiment of a terminal contact 40. The terminal contact 40 comprises a backbone 41 with a first end 42 connected to a base 43. The other end 44 of the backbone carries a crimp connection 45 for attachment to a cable. The base 43 connects the first end 42 of the backbone 41 to a root end 46 of a contact beam 47 of the terminal contact 40. The base 43 is formed by a folded strip. One of the folding lines L is between the backbone 41 and the contact beam 47, such that the contact beam 47 is parallel but not co-planar with the backbone 41. The strip is folded to form a rectangular pin receiving opening 48. The opposite end 49 of the contact beam 47 points towards the crimp connection 45 and comprises a flange 50 folded along a folding line L1 under about a 90 degrees angle with the root end of the contact beam. The folding line L1 makes an acute angle with the backbone and the folding line L.

In the embodiment of FIG. 7, the terminal contact 60 comprises a backbone 61 with a mid-section 62 connecting a crimp connection section 63 to a section 64 carrying the contact beams 65. Section 64 is substantially similar to the corresponding section of the terminal contact of FIG. 1. The mid-section 62 makes an acute angle with the longitudinal direction of the contact beams 65 to offset the pin receiving cavity from the crimp connection. This prevents that an inserted contact pin would brush over the crimped cable conductors.

In FIG. 8 a terminal contact 70 is shown with a backbone 71 with a mid-section 72 connecting a crimp connection section 73 to a section 74 carrying the contact beams 75. The mid-section 72 is flexible. This helps to reduce transfer of vibrational loads from the cable end of the contact 70 to the section 74 with the contact beams 75.

FIG. 9 shows a further alternative embodiment of a terminal contact 80 with two longer contact beams 81, 82 and two short contact beams 83, 84. A blank 86 of the terminal contact 80 is shown in FIG. 10. At a pin receiving side 87 the terminal contact 80 comprises a front base 88 connected to front sections of the longer contact beams 81, 82 and connected to respective root ends 89, 90 of the two contact beams 83, 84. The front base 88 has a four sided cross section and is folded along a folding lines L1, L2, L3 (see FIG. 10) between the longer contact beams 81, 82 and the shorter contact beams 83, 84.

At a cable connection side 92 the terminal contact 80 comprises a rear base 93 with a four-sided cross section. The two opposite longer contact beams 81, 82 extend between the front base 88 and the rear base 93 and have a front section 94, 95 extending from a side of the front base 88, a rear section 97, 98 extending from a side of the second base 93, and a midsection 99, 100 connecting the rear and front sections. The front and rear sections of the longer contact beams 81, 82 have parallel longitudinal directions but extend in different planes defining different adjacent sides of the terminal contact 80.

A first short contact beam 83 extends from the front base 88 between the two longer contact beams 81, 82. The short contact beam 83 has a root end 102, a contact end 103 and a midsection 104 connecting the root end 102 to the contact end 103. The root end 102 is connected to the front base 88 and extends between the front sections 94, 95 of the two adjacent longer contact beams 81, 82 in the direction of the rear base 93. The contact end 103 extends between the rear sections 97, 98 of the two longer contact beams 81, 82 and is folded sideward along a folding line parallel to the pin insertion direction over a 90 degrees angle with the root end 102. The contact end 103 has an inwardly bent tip 106 forming a contact face for an inserted contact pin.

The second contact beam 84 extends from an outer end of the first base 88 and also has a root end 107, a contact end 108 and a midsection 109 connecting the root end 107 to the contact end 108 in a similar arrangement. The contact end 108 of the second contact beam is folded over a 90 degrees angle with the root end 107 and partly overlaps the front section 94 of the longer contact beam 81 extending from the opposite side of the front base 88. The contact end 108 has an inwardly bent tip 111 forming a contact face for an inserted contact pin.

The front sections of both longer contact beams 81, 82 are provided with an inwardly bulging surface 112, 113 at different distances from the front base 88.

The front base 88 and the rear base 93 are both provided with a flag 114, 115 comprising a recess 116, 117 for receiving a projection 118, 119 at the opposite side of the respective base 88, 93.

As is particularly shown in FIG. 9, the midsection 109 of the shorter contact beam 84 overlaps the contact area 112 of the longer contact beam 82. If, in an alternative embodiment, the shorter contact beam 84 would tightly overlap the contact area 112, it would form a support beam backing the contact area and increasing the contact force exerted by the contact area 112 to an inserted contact pin. In that case, the beam 84 should not be used as a contact pin and it should not have a bent tip.

FIG. 11 shows a terminal contact 120 which is similar to the one of FIG. 9, with the difference that the short beams 83*a*, 84*a* are not contact beams but support beams backing the respective contact sections 112, 113 of the longer contact beams 81, 82. The support beams 83*a*, 84*a* increase the normal force exerted by the contact area 112, 113 to a mating contact pin.

FIG. 12 shows a further possible embodiment 121, also similar to the embodiment of FIG. 9, but with the difference that the short beams 83*b* extend forwardly from the rear base 93 into the direction of the front base 88. To facilitate easy insertion of a pin the contact areas can be staggered. After insertion of a contact pin through the front base 88 the pin first contacts the contact area of the lower long contact beam 81, then the contact area 112 of the upper long contact beams 82 and subsequently the respective bent tips 111, 106 of the shorter contact beams 83*b*, 84*b*.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the invention as described herein, and changes may be made without departing from the spirit and scope of the invention, for instance as set forth by the appended claims.

The invention claimed is:

1. A connector comprising:

at least one pin receiving terminal contact comprising:

a base comprising a folded strip; and a plurality of contact beams having a root end extending from said base, wherein the plurality of contact beams comprise:

at least a first pair of oppositely arranged contact beams having contact faces bent sideward under an angle with said root end, such that the first pair of oppositely arranged contact beams form rear contact areas;

at least a second pair of oppositely arranged contact beams, shorter than the first pair of contact beams, having contact faces forming front contact areas such that the front contact areas are disposed on the same sides of the terminal contact as the rear contact areas.

2. A connector according to claim 1, wherein:

the first pair of oppositely arranged contact beams comprises a first a second contact beam; and the second pair of oppositely arranged contact beams comprises a third and fourth contact beam, wherein the contact face of the first contact beam is bent sideward to be in line with the third contact beam.

3. A connector according to claim 2, wherein the contact face of the third contact beam is bent sideward to be in line with the fourth contact beam.

4. A connector according to claim 1, wherein one of the front contact areas and one of the rear contact areas are disposed at one side of the terminal contact, and the line through the one of the front contact areas and the one of the rear contact areas makes an angle to the pin insertion direction.

5. A connector according to claim 1, comprising a pin receiving space, which is four-sided in cross section, wherein two opposite sides of the pin receiving space are defined by the first pair of oppositely arranged contact beams and the other two sides of the pin receiving space are defined by the second pair of contact beams.

6. A connector according to claim 5, wherein the plurality of contact beams extend from the base in a direction coinciding with a pin insertion direction.

7. A connector according to claim 5, wherein the plurality of contact beams extend from the base in a direction opposite to a pin insertion direction.

8. A connector according to claim 1, wherein the rear contact areas and the front contact areas are at different distances from the base.

9. A connector according to claim 1, wherein the terminal contact comprises a backbone with a cable connection end.

10. A connector according to claim 9, wherein the cable connection end of the backbone is provided with a crimp connection for attachment to a cable.

11. A connector according to claim 10, comprising a mid-section which offsets the pin receiving base from the cable end connection.

12. A connector according to claim 11, wherein the midsection is flexible.

13. A connector according to claim 12, wherein the backbone overlaps one of the contact beams.

14. A connector according to claim 13, wherein the terminal contact comprises a front base, a rear base and one or more beams having:

a front section connected to a first side of the front base;

a rear section connected to a side of the rear base in line with a second side of the front face; and a folded mid-section connecting the front end to the rear end.

15. A connector according to claim 14, wherein the contact beams of both the first pair of oppositely arranged contact beams and the second pair of oppositely arranged contact beams have a root end connected to a side of the front or rear base.

16. A connector according to claim 15, wherein contact beams of the second pair of oppositely arranged contact beams have a root end connected to the front base, a free end extending between the rear sections of the first pair of oppositely arranged contact beams and a mid-section bridging the root end and the free end.

17. A connector according to claim 1, wherein at least one contact beam of the first pair of oppositely arranged contact beams has the root end extending from the base and the contact face bent sideward along a folding line making an acute angle with a pin insertion direction.

18. A connector according to claim 1, wherein one or more contact areas of the rear and front contact areas are formed by bulging contact bumps or domes on the contact beams.

19. A connector according to claim 18, wherein the terminal contact comprises at least one side with contact areas on different contact beams, wherein at least one of the contact areas on the at least one side is formed by a dome.

20. A connector according to claim 18, wherein the shape of the dome is configured to exert a pressure to an inserted pin of the same order as the other contact area at the same side of the terminal contact.

21. A connector according to claim 1, further comprising a contact beam extending from one side of the base, wherein the contact beam is configured to pre-load a contact beam extending from an adjacent side of the base.

22. A connector according to claim 21, wherein the terminal contact comprises one or more support beams backing the contact area of an associated contact beam.

23. A terminal contact for a connector, the terminal contact comprising:

a pin receiving space;

a pair of rear contact areas disposed on opposite sides of the pin receiving space; and a pair of front contact areas disposed on opposite sides of the pin receiving space, wherein:

each of the pair of rear contact areas and each of the pair of front contact areas are disposed on contact beams extending from a contact receiving end of the pin receiving space; and contact areas of the pair of rear contact areas are disposed on the same skies of the pin receiving space as contact areas of the pair of front contact areas.

24. A terminal contact according to claim 23, wherein the terminal contact is folded from a single stamped blank of sheet metal.

25. A method for manufacturing a terminal contact, the method comprising:

stamping a blank from a sheet metal, the blank comprising:

a base strip and one or more contact beams extending from the base strip; and at least a first contact beam having a root end extending from the base strip folding the base strip to form a contact face bent sideward under an angle with said root end, wherein:

at least two contact beams are provided with sideward extending flanges pointing in the same direction, wherein the flanges are first bent upwardly before folding the base strip, and the blank comprises two longer contact beams carrying the sideward extending flanges, a first shorter contact beam between the two longer beams and a second shorter contact beam at a second end of the base strip.

26. A method for connecting a terminal contact and a complementary contact, comprising:

inserting the complementary contact into a pin receiving space of the terminal contact such that pins of the complementary contact make contact with a pair of rear contact-areas and then with a pair of front contact areas of the terminal contact, wherein:

the pair of rear contact areas are disposed on opposite sides of the pin receiving space;

the pair of front contact areas are disposed on opposite sides of the pin receiving space;

each of the pair of rear contact areas and each of the pair of front contact areas are disposed on contact beams extending from a contact receiving end of the pin receiving space in a direction coinciding with a pin insertion direction; and the pair of rear contact faces and the pair of front contact areas are disposed on the same sides of the pin receiving space.

27. The terminal contact of claim 23, wherein each of the pair of rear contact areas and each of the pair of front contact areas extend from a contact receiving end of the pin receiving space in a direction coinciding with a pin insertion direction.

28. The method of claim 26, wherein each of the pair of rear contact areas and each of the pair of front contact areas extend from a contact receiving end of the pin receiving space in a direction coinciding with a pin insertion direction.

29. The terminal contact of claim 23, comprising a mid-section which offsets the pin receiving base from the cable end connection.

30. The method of claim 26, wherein the contact beams are configured to pre-load the other contact beam extending from an adjacent side of contact receiving end of the pin receiving space.

31. The terminal contact of claim 23, wherein the mid-section is flexible.

32. The terminal contact of claim 23, wherein the contact beams are configured to pre-load the other contact beam extending from an adjacent side of contact receiving end of the pin receiving space.

33. The method of claim 26, wherein the contact beams are arranged in a first and second pair, and the pin receiving space is four-sided in cross section, wherein two opposite sides of the pin receiving space are defined by the first pair of oppositely arranged contact beams and the other two sides of the pin receiving space are defined by the second pair of contact beams.

* * * * *